US009517369B2

(12) United States Patent
Samouhos et al.

(10) Patent No.: US 9,517,369 B2
(45) Date of Patent: Dec. 13, 2016

(54) FIRE STOP CONDUIT

(71) Applicants: Stephen Samouhos, Paramus, NJ (US); Anthony Orsano, Williston Park, NJ (US); George Samouhos, Garfield, NJ (US)

(72) Inventors: Stephen Samouhos, Paramus, NJ (US); Anthony Orsano, Williston Park, NJ (US); George Samouhos, Garfield, NJ (US)

( * ) Notice: Subject to any disclaimer, the term of this patent is extended or adjusted under 35 U.S.C. 154(b) by 0 days.

(21) Appl. No.: 14/457,232

(22) Filed: Aug. 12, 2014

(65) Prior Publication Data

US 2016/0045773 A1 Feb. 18, 2016

(51) Int. Cl.

| | |
|---|---|
| ***H01B 7/00*** | (2006.01) |
| ***A62C 2/06*** | (2006.01) |
| ***H01B 7/295*** | (2006.01) |
| ***A62C 3/16*** | (2006.01) |

(52) U.S. Cl.

CPC ..... *A62C 2/065* (2013.01); *A62C 3/16* (2013.01); *H01B 7/295* (2013.01)

(58) Field of Classification Search

CPC ..... H01B 7/29; H01B 7/292; H01B 7/32; H01B 7/324; H01B 7/361; H01B 7/365

USPC ..... 174/110 R, 112, 118, 120 R–124 GC

See application file for complete search history.

(56) References Cited

U.S. PATENT DOCUMENTS 2,186,793 A * 1/1940 Wodtke ..... H01B 7/1895 156/55
2,787,118 A 4/1957 Markham
3,588,776 A * 6/1971 Horwinski ..... H01B 7/32 174/115
3,610,808 A * 10/1971 Horwinski ..... H01B 7/32 174/110 PM
3,639,727 A 2/1972 Leach
3,904,111 A 9/1975 Petersson
4,018,983 A * 4/1977 Pedlow ..... C08K 13/04 106/18.24
4,154,976 A * 5/1979 Brorein ..... H01B 7/295 174/102 R
4,319,940 A * 3/1982 Arroyo ..... H01B 7/295 156/185
4,510,348 A * 4/1985 Arroyo ..... H01B 7/295 174/121 A (Continued)

OTHER PUBLICATIONS

Pyroplex Fire Containment Systems. Fire rated expanding foam—Pyroplex Ltd. www.pyroplex.com/penetration-products/expanding-foam/. Accessed on Dec. 31, 2013.

*Primary Examiner* — William H Mayo, III

(74) *Attorney, Agent, or Firm* — Michael J. Feigin, Esq.; Feigin & Fridman, LLC

(57) ABSTRACT

Methods and/or apparatuses having a conduit with at least one length of conductive metal wire therein along with a length of non-conductive wire therein. The length of non-conductive wire includes a heat-expandable firestop insulator material. Upon reaching a pre-defined temperature corresponding to that of a fire, the non-conductive wire expands to fill a length of the conduit. Alternatively, the firestop insulator material may be disposed in the void within the conduit that exists outside of the conductors. The expansion of the material prevents the spread of fire along the length of the conduit.

20 Claims, 6 Drawing Sheets

(56) References Cited

U.S. PATENT DOCUMENTS

| | | | | |
|---|---|---|---|---|
| 4,513,173 | A * | 4/1985 | Merry | G02B 6/4436 138/103 |
| 4,881,995 | A * | 11/1989 | Arenz | H01R 4/72 156/229 |
| 5,424,895 | A * | 6/1995 | Gaston | H02H 5/043 324/539 |
| 5,750,927 | A * | 5/1998 | Baltazar | A62C 3/16 169/48 |
| 6,352,362 | B2 * | 3/2002 | Thermos | 136/226 |
| 7,378,595 | B2 * | 5/2008 | Brambilla | H01B 3/04 174/113 R |
| 7,939,764 | B2 * | 5/2011 | Gottfried | H01B 3/443 174/110 R |
| 8,291,941 | B1 | 10/2012 | Berardi | |
| 8,330,045 | B2 * | 12/2012 | Huang | H01B 3/302 174/110 R |
| 8,393,121 | B2 | 3/2013 | Beele | |
| 8,502,078 | B2 | 8/2013 | Nonaka | |
| 2003/0178220 | A1 * | 9/2003 | Barusseau | C08K 9/02 174/110 PM |
| 2005/0257460 | A1 * | 11/2005 | Semler | F16L 59/145 52/232 |
| 2006/0213138 | A1 | 9/2006 | Milani et al. | |
| 2007/0246240 | A1 * | 10/2007 | Alexander | C04B 26/02 174/36 |
| 2008/0217043 | A1 * | 9/2008 | Schoke | H02G 3/0412 174/110 R |
| 2013/0234405 | A1 | 9/2013 | Beele | |

* cited by examiner

FIRE STOP CONDUIT

FIELD OF THE DISCLOSED TECHNOLOGY

The disclosed technology relates generally to fire prevention, and more particularly to prevention of the spreading of fires through electrical conduits.

BACKGROUND OF THE DISCLOSED TECHNOLOGY

In a technologically advanced society, personal injuries and financial damage continue to result from structure fires all over the world. While electricity makes our lives easier in many ways, the increase in electronically powered devices in a given building means a greater number of wires laid throughout the structure of the building. Having a great number of wires increases the risk of a faulted or frayed wire. Furthermore, a greater number of wires results in faster spreading of fire started from other sources. Due to the wires' conduction of heat and/or electricity, fires are easily spread along conductors to different rooms and portions of a structure.

Different devices and materials are often used at electrical through-penetrations to prevent the spread of fire. Through-penetrations are the openings between rooms or portions of a given structure through which utility conduits pass. Typically, such conduits are plumbing pipes, stand-alone wires, or conduits containing wires. The fire-resistant materials used provide an effective impedance to the spread of fires. One such device and/or material used to prevent fire from spreading through these junctures is firestop. Firestop components typically involve intumescents, cemetitious mortars, silicone, firestop pillows, mineral fibers and rubber compounds strategically places at through-penetrations and other locations to impede the spread of a fire.

While these firestop systems prove effective in preventing the spread of fire to different rooms or regions of a building, they are typically only used at through-penetrations and thus only stop the burning of conduits at these points. Thus, in a large room or long corridor, where no through-penetrations exist, there may not be any firestop systems along a large length of a given conduit. As such, no effective measure would be place to prevent the spread of a fire throughout that particular room or corridor.

SUMMARY OF THE DISCLOSED TECHNOLOGY

Therefore, it is an object of the disclosed technology to prevent the spreading of fires through an entire length of an electrical conduit.

In an embodiment of the disclosed technology, a conduit has opening on at least two ends thereof. The conduit has a conductive metal wire extending substantially to said at least two ends. The conduit also has a non-conductive wire that is formed primarily of heat-expandable material. The non-conductive wire extends substantially to said at least two ends. The non-conductive wire is calibrated to fill a cross-section of said conduit upon reaching a threshold temperature.

"Substantially" is defined as covering an entire distance of within 20 cm of a total length of the conduit, or at least 95% of an entire length of the conduit. "Conduit" is defined as an elongated tube having a hollow passageway extending at least substantially there through from a first opening to a second opening. The tube may have a circular, rectangular, or other shaped cross-section. A "wire" is defined as an elongated, thin, flexible thread or rod of material. "Conductive," for purposes of this disclosure, is defined as "designed for transmission of electric power or electric signals." A "non-conductive wire," for the purposes of this disclosure, is defined as an elongated length of material designed to insulate (stop) the passage of electric signals there through. The non-conductive wire may consist or comprise of a single strand of such wire, or multiple strands which are run together or separately through a conduit, forming the entirety of the "non-conductive wire". The "cross-section" of the wire is defined as the surface or shape that is or would be exposed by making a straight/perpendicular cut through any portion of the length of the conduit.

In a further embodiment of the disclosed technology, the non-conductive wire occupies less than 25% of the cross-section before expansion, and occupies greater than 90% of said cross-section after expansion. Still further, all of the wires in the conduit, including the non-conductive wire, may be braided or intertwined with one another. In another embodiment, the non-conductive wire may surround the conductive wire or wires. The non-conductive wire may be permanently affixed to the conductive wire as well. "Permanently affixed" is defined as being irreversibly adhered to or around the conductive wire. Further, the non-conductive wire may fill at least a majority of a void between the conductive wire and the conduit.

In still a further embodiment of the disclosed technology, the filled cross-section extends along a substantially the length of the conduit between the at least two ends. Upon the threshold temperature being reached, the non-conductive wire expands to multiple times its original volume/cross-section. The expanding material may cause the conductive wires and/of the outer sleeve to rupture. At the very least, the material shall engulf the conductive wires, thereby preventing the spread of heat and fire along the length of the conductive wire and/or the conduit.

In another embodiment of the disclosed technology, a conduit has an opening on at least two ends thereof. The conduit has at least one conductive wire extending along an interior length of the conduit, between the two ends. The conduit also has a sleeve or outer covering surrounding the wire and extending between the two ends of the conduit. The sleeve may be formed of an insulating material, such as a polymer or rubber. A "sleeve" is defined as a tubular, flexible insulation in which a bare metal wire may be disposed or inserted. The space between the sleeve and conductive wires may define a void. A volume of heat-expandable, non-conductive material injected into the void.

In a further embodiment the heat-expandable, non-conductive material may occupy at least 90% of the void extending substantially between the two ends. The non-conductive material may be expandable to rupture the conductive wire upon exposure to heat exceeding a temperature threshold. The expanding material may also rupture the sleeve of the conduit such that the entire conduit is engulfed in the non-conductive material.

It should be understood that the use of "and/or" is defined inclusively such that the term "a and/or b" should be read to include the sets: "a and b," "a or b," "a," "b." Further details are set forth in the detailed description below.

DETAILED DESCRIPTION OF EMBODIMENTS OF THE DISCLOSED TECHNOLOGY

Embodiments of the disclosed technology are directed to apparatuses having a conduit with at least one length of conductive metal wire therein along with a length of non-conductive wire therein. The length of non-conductive wire comprises a heat-expandable firestop insulator material. Upon reaching a pre-defined temperature corresponding to that of a fire, the non-conductive wire expands to fill a length of the conduit. Alternatively, the firestop insulator material may be disposed in the (former) void within the conduit that exists outside of the conductors. The expansion of the material prevents the spread of fire along the length of the conduit.

Embodiments of the disclosed technology will become clearer in view of the following description of the Figures.

Figure 1:
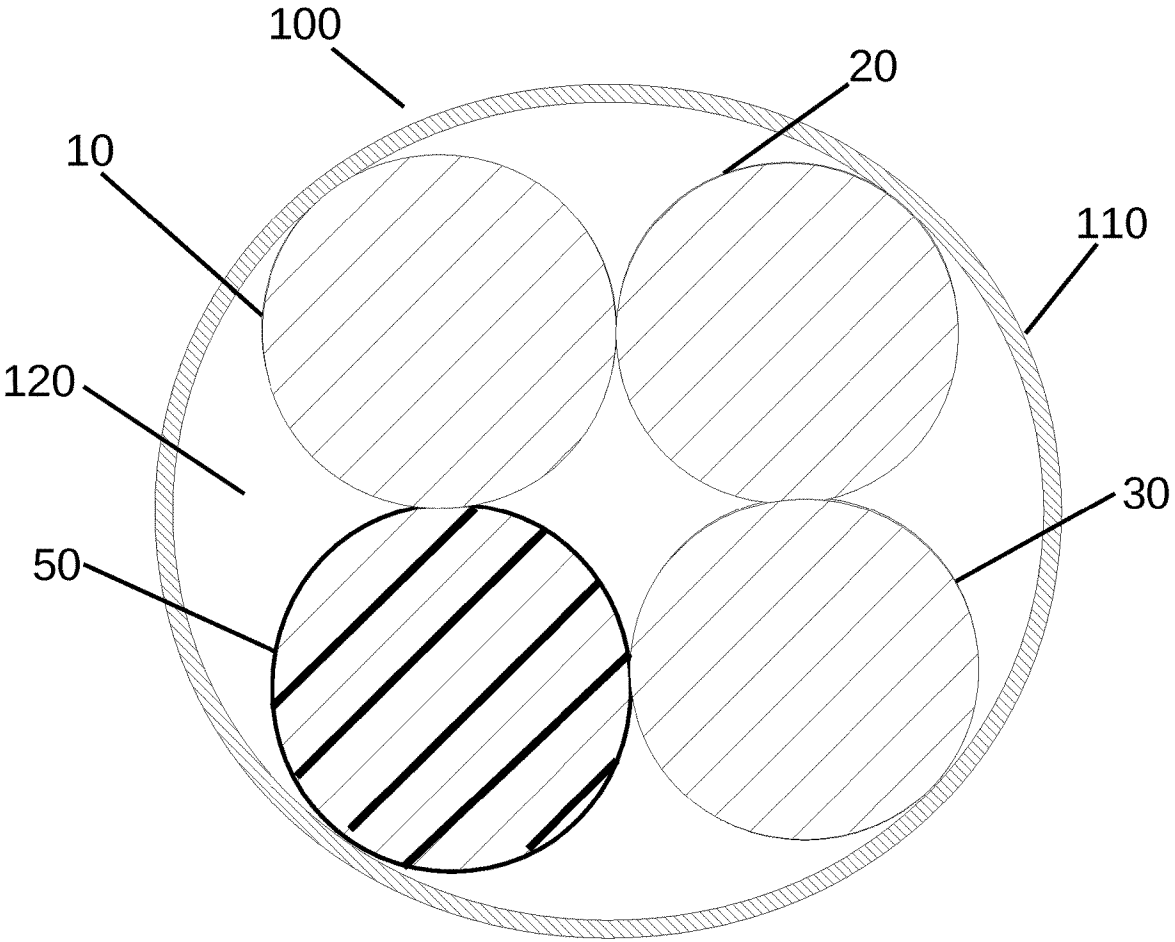
FIG. 1 shows a cross sectional view of a conduit having a non-conductive heat-expandable wire according to an embodiment of the disclosed technology.

FIG. 1 shows a cross sectional view of a conduit having a non-conductive heat-expandable wire according to an embodiment of the disclosed technology. The conduit 10 is generally formed of an outer sleeve 110 with one more conductors (wires) 10, 20, 30 (hereinafter collectively referred to as "conductors 40" as labeled in FIG. 5) extending there-through. The outer sleeve 110 may be formed rubber, polymer, elastomer, or other insulating material. In the particular embodiment shown, the conduit 100 contains a first conductor 10, a second conductor 20, and a third conductor 30. The three conductors 10, 20, 30 may represent the positive lead, negative lead, and ground lead, respectively, of a typical electrical conduit.

Referring still to FIG. 1, a fourth component disposed within the sleeve is a length non-conductive wire 50. The non-conductive wire 50 is formed of a heat-expandable firestop insulator material. Thus, the entire length of the non-conductive wire 50 may be homogenous. Though the non-conductive wire 50 is shown the same size as the conductive wires, it should be understood that the non-conductive wire, before heat expansion, may be any size, including smaller or larger in diameter than any other, or the totality of conductive wires in the conduit. A void 120 exists in the empty space surrounding the conductors 40. In the event of a fire in the vicinity of the conduit 10, the firestop material which forms the non-conductive wire 50 will expand to engulf and/or break the conductors 40. The material may also expand to the extent that the conduit sleeve 110 becomes expanded or ruptured. The expansion of the material along the entire length of the conduit 100 prevents fire from spreading to the conductors and/or along the length the of the conduit.

The firestop material used to form the non-conductive wire may be an intumescent. Intumescents are substances that swell as a result of heat exposure. The swelling causes an increase in volume and a correlating decrease in density. Intumescents typically come in two forms: 1) soft chars and 2) hard chars. Soft chars contain a significant amount of hydrates which retard heat transfer. As the hydrates are heated, water vapor is released which provides a cooling effect, thereby further preventing the transfer of heat. The expanded material blocks the spread of fire by formed a non-flammable, soft carbonaceous char. Hard chars on the other hand are composed of sodium silicates and/or graphite. These chars produce a much greater expansion pressure which is capable of exerting a greater force on surrounding objects. As such, a hard char may be more suitable for embodiments in which a small volume or void is filled with firestop material.

Figure 2:
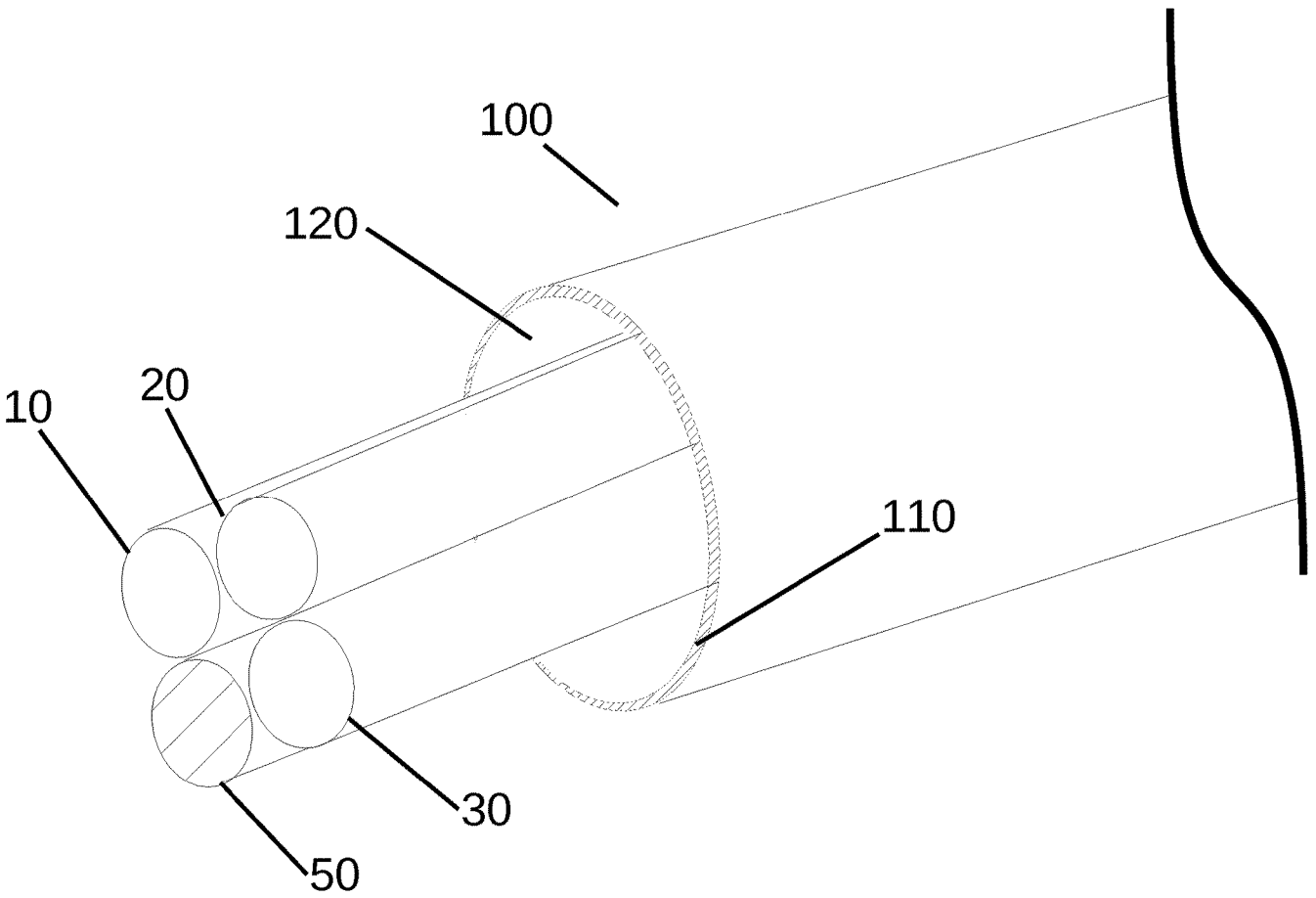
FIG. 2 shows a perspective cut away view of the conduit of FIG. 1.

FIG. 2 shows a perspective cut away view of the conduit of FIG. 1. The conduit 100 has an elongated cylindrical body. The sleeve 110 extends along the entire length of the conduit 100. The sleeve 110 defines a hollow interior or void 120. A plurality of elongated conductors 40 or wires extends through the void 120. The conductors 40 transport electricity, heat, and/or data along their length. Any number of conductors 40 may be employed in any configuration within the conduit 100. In the example shown, the conduit contains a positive lead 10, a negative lead 20, and a ground lead 30. The fourth wire extending from the conduit 100 is the non-conductive wire 50 formed of heat-expandable firestop insulator material. The non-conductive wire 50 is threaded through or placed into the conduit at the same time as the conductors 40. The non-conductive wire 50 may have dimensions of similar proportion to those of the conductors 40.

Figure 3:
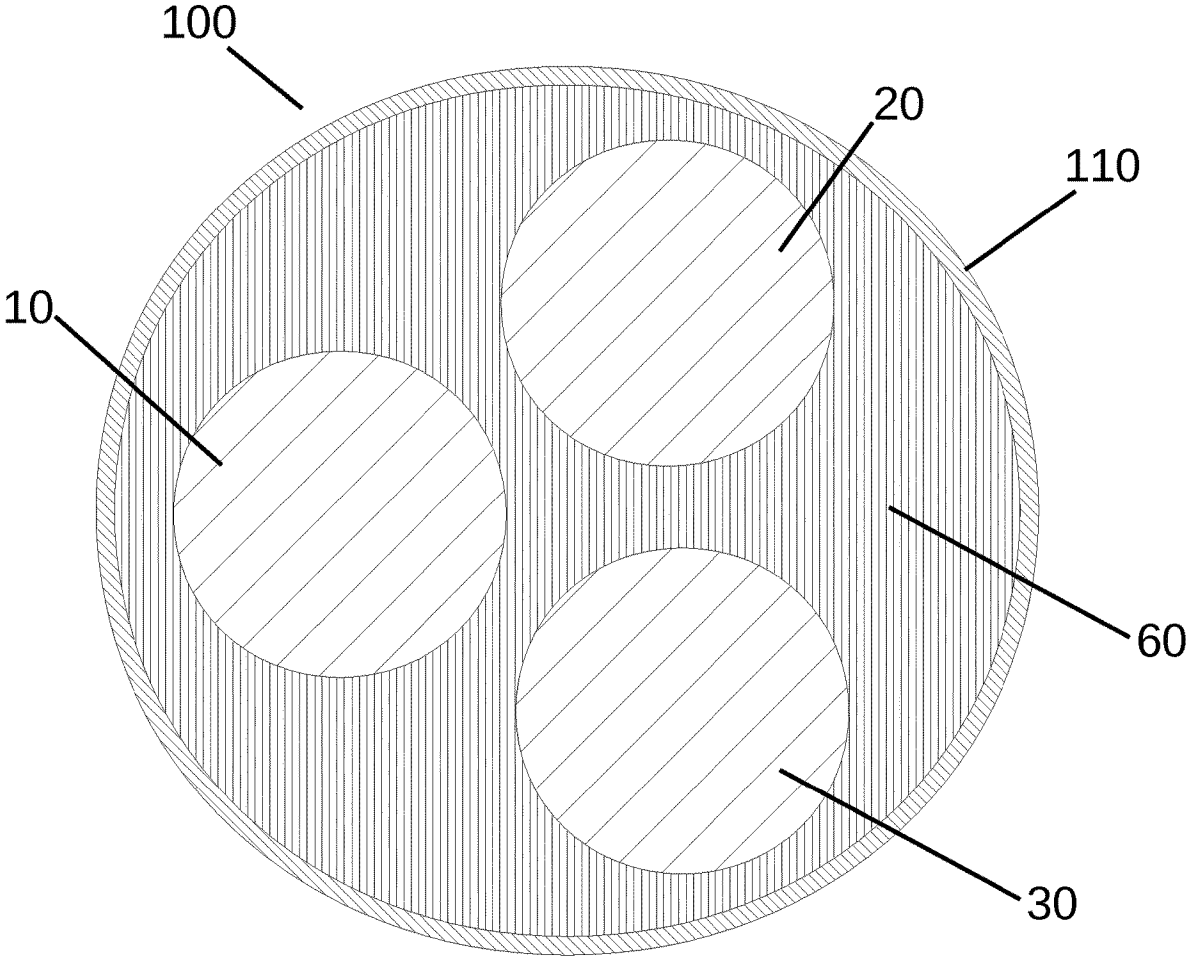
FIG. 3 shows a cross sectional view of a conduit having a non-conductive heat-expandable material disposed around conductors according to an embodiment of the disclosed technology.

FIG. 3 shows a cross sectional view of a conduit having a non-conductive heat-expandable material disposed around conductors according to an embodiment of the disclosed technology. In this embodiment, a firestop filling 60 is injected to fill the void within the conduit 100 outside of the other conductors 40. The filling 60 may be intumescense, which, when applied, takes the form of a viscous substance. The filling 60 maintains a degree of elasticity and flexibility upon hardening within the conduit 100. The filling 60 is constrained to the conduit 100 by the sleeve 110 of the conduit. When heat is applied to the conduit 100 that is of a sufficient temperature to activate the filling 60, the filling expands thereby engulfing the conductors 40 and rupturing the outer sleeve 110. Alternatively, FIG. 3 shows a condition after the firestop material has expanded to fill the conduit after being heated about a threshold temperature.

Figure 4:
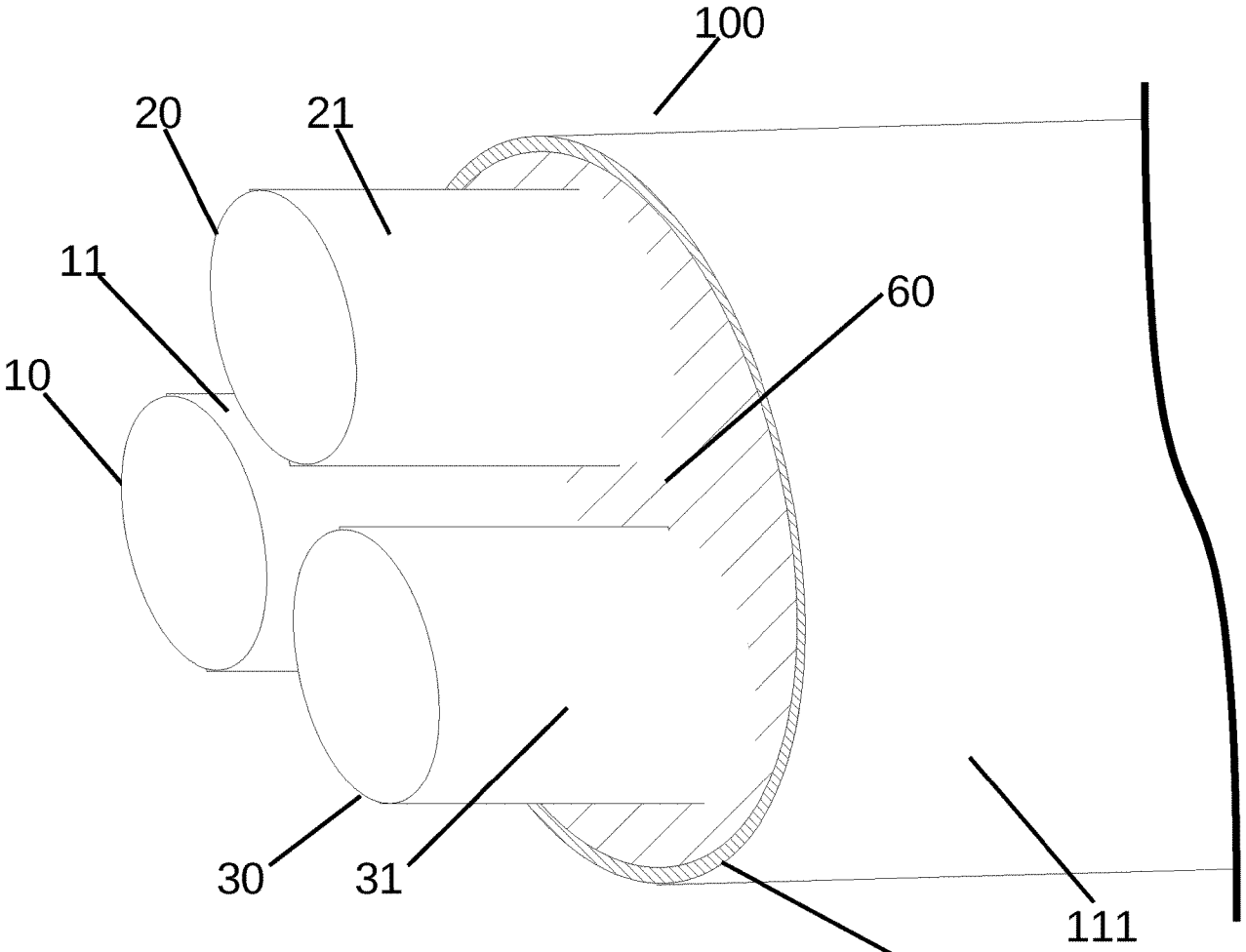
FIG. 4 shows a perspective cut away view of the conduit of FIG. 3.

FIG. 4 shows a perspective cut away view of the conduit of FIG. 3. As depicted, the filling 60 takes up the entirety of the volume of interior of the conduit 100 that is not occupied by the conductors 40. The conductors 40 extend through the length of the conduit 100. The arrangement of the filling 60 around the conductors 40 may cause the conductors to break or rupture as well as the filling expands under applied heat. Regardless of whether the conductors 40 are broken or engulfed, a fire will not be able to be transmitted or spread via the conductors due to the flame-retardant nature of the filling. Depending on the density of the filling 60, the conductors 40 may be drawn apart from one another and therefore be broken.

Figure 5:
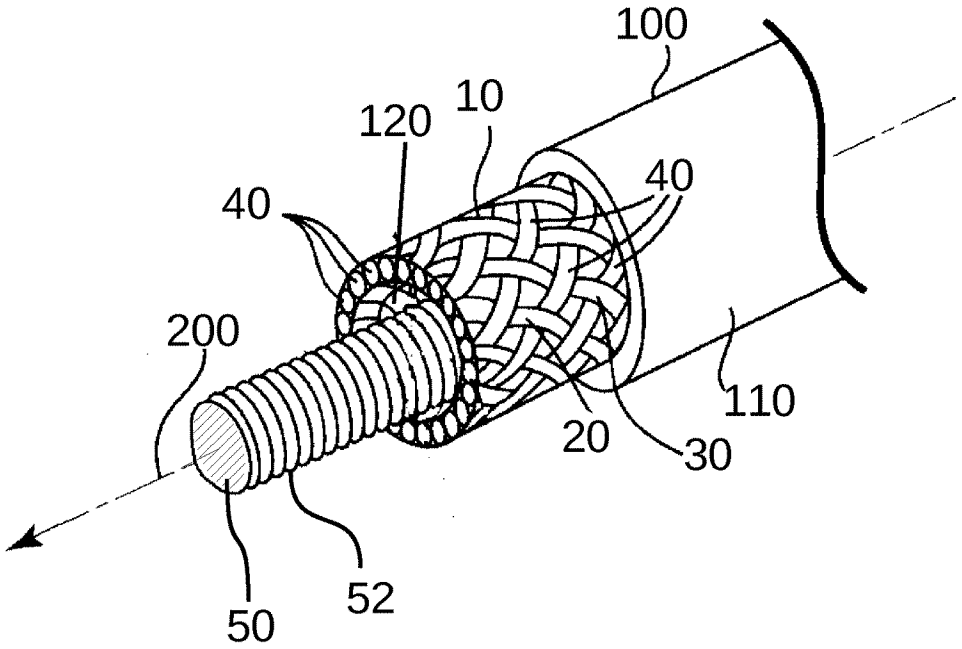
FIG. 5 shows a perspective cut away view of the conduit having a length on non-conductive heat-expandable material disposed through a central axis thereof according to embodiments of the disclosed technology.

FIG. 5 shows a perspective cut away view of the conduit having a length on non-conductive heat-expandable material disposed through a central axis thereof according to embodiments of the disclosed technology. In this embodiment, a length of non-conductive firestop tube or wire 50 extends through the conduit 100 along a central axis 200 thereof. The central axis 200 defines the center of mass of a cross section of the conduit 100. The conductors 40 are braided around the heat-expandable wire 50. The conductors 40, may include a plurality of wires or leads, such as, for example, a positive lead 10, a negative lead 20, and a ground lead 30. A void 120 may exist between the conductors 40 and the non-conductive tube 50. Alternatively, wire 40 contains or comprises strands of heat-expandable material, whereas wire 50 is a conductive metal wire carrying electrical current or signals.

The non-conductive tube 50 may have ridges 52 extending along an outer surface thereof 52. Upon application of a flame to the non-conductive tube 50 the heat-activated material expands to at least the conductors 40. Depending on the density of the filling forming the non-conductive tube 50, the expansion of the filling may either engulf, rupture or pull apart the braided conductors 40. Further, the expansion of the non-conductive tube 50 may rupture the sleeve 110 of the conduit 100.

In an alternative embodiment, one or more of the braid wires 40 may be a non-conductive heat-expandable wire. In this embodiment, other conductors may extend along the central axis 200 of the conduit 100 or be intertwined with the braided non-conductive wire. If the entire braided portion 40 of the conduit 100 is formed of heat-expandable material, the interior conductors would be inaccessible by a flame because a fire would first reach the exterior non-conductive wire and cause expansion of the wire prior to reaching the interior conductors.

Thermal conductivity of the intumescense that is used as the filling may vary. A given intumescense has an active or transition temperature of $T_a$. This represents the temperature at which the intumescense coating should divide into two layers. The two layers are called the virgin layer and the char layer. This division is governed by the effective thermal conductivity of the intumescense. Assuming a constant specific mass and a constant specific heat, the effective thermal conductivity of the intumescense is governed by the following equation:

$$c\rho\left(\frac{\delta T}{\delta t}\right) = k_{eff}\left(\frac{\delta}{\delta x}\right)\left(\frac{\delta T}{\delta x}\right) \quad \text{Eq. 1}$$

Where $0<x<L(t)$. Thus, at the surface or boundary of the intumescense coating, the heat entering the char is equal to the heat arriving at the coating minus any heat losses due to convection and/or radiation. Thus, the coefficient of thermal conductivity, $k_{eff}$, over this gradient is governed by:

$$k_{eff}\frac{\delta T}{\delta x}\int_{x=L(t)} = \varepsilon q_r - h_c(T - T_a) - \varepsilon\sigma(T^4 - T_a^4) \quad \text{Eq. 2}$$

Where $q_r$ is the radiant heat flux emitted and $x=L(t)$. The effective thermal conductivity of an intumescense may be used to determine how much filling is needed in embodiments of the disclosed technology. These defined reaction mechanisms account for an initial stage of preheating where thermal energy is absorbed by the coating and its temperature increases quick. When the temperature at the virgin coating surface reaches the an activation temperature, heat is absorbed by the coating, and gas bubbles are formed thereby resulting in initiation of growth of a black carbonaceous char.

As the heat propagates through the virgin material (the unheated intumescense) the carbonaceous char keeps growing until the moving boundary reaches the substrate and the entirety of the intumescense coating has been consumed. The growing of the char demonstrates the heat-expanding properties of the firestop material. Given the above equations, the amount of virgin material exponentially increases the volume of the char upon exposure to heat. Thus, the amount of firestop material needed to engulf or rupture the conductive wires may be determined using these equations.

Figure 6:
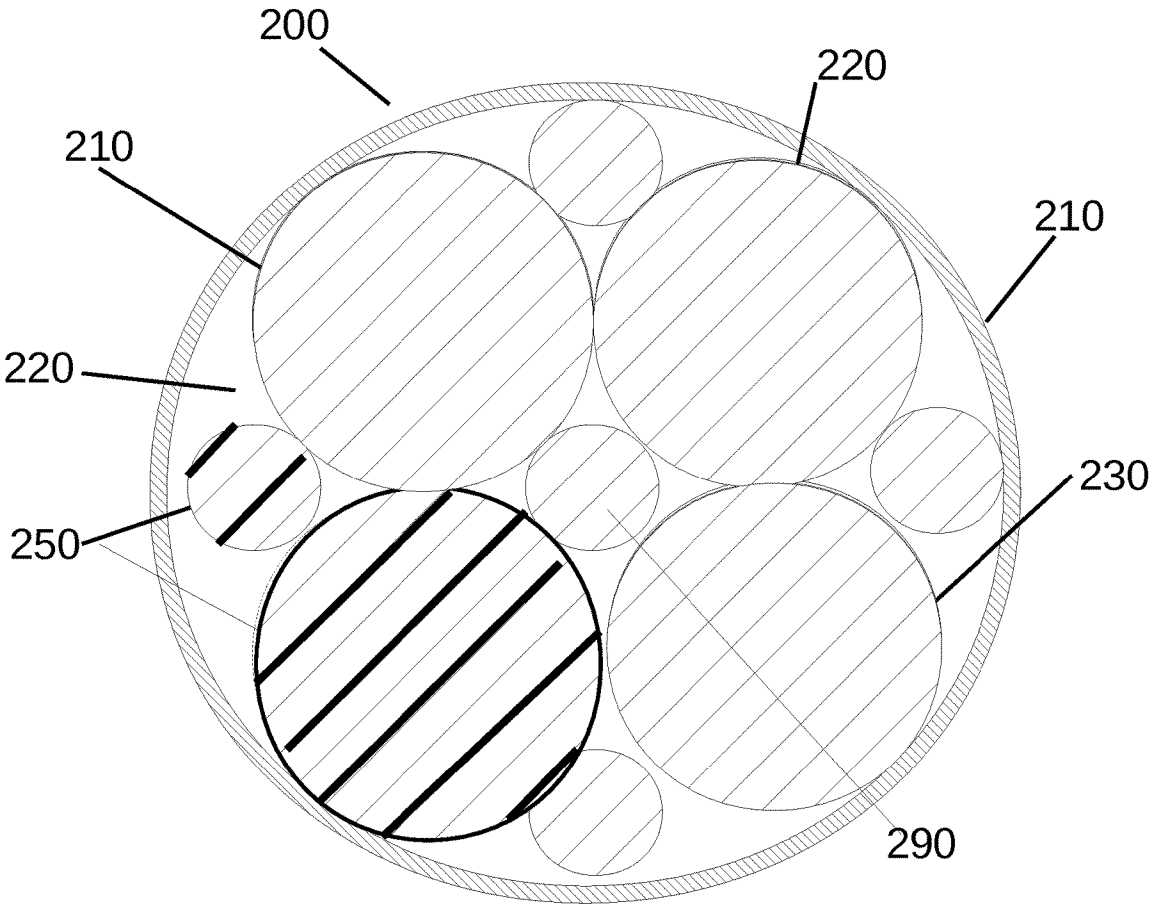
FIG. 6 shows a cross sectional view of a conduit having a multiple non-conductive heat-expandable wires according to an embodiment of the disclosed technology.

FIG. 6 shows a cross sectional view of a conduit having a multiple non-conductive heat-expandable wires according to an embodiment of the disclosed technology. The labels have been incremented by 100 compared to that of FIG. 1, where applicable. The conductive wires 210, 220, and 230 are interspersed with firestop wires 250. The firestop wires expand to fill the open space 220 and may also break the conductive cables which transport electrical signals and/or current.

In embodiments of the disclosed technology, a heat sensitive wire, such as wire 290 may be used. This wire may be a conductive wire or a firestop wire or both. In the art, this is known as a "resistance thermometer" which has sensors used to measure temperature by determining temperature based on resistance in the wire. This may be accomplished, for example, by using a length of fine coiled wire wrapped around a ceramic or glass core, as represented by 290 in FIG. 6. The element is usually quite fragile, so it is often placed inside a sheathed probe to protect it. The wire has a predictable change in resistance as the temperature changes and thus, the temperature is determined. Multiple wires may make up wire 290, such as two, three, or four wires, depending on need. The temperature information is sent back to a processing unit, and this may cause the firestop material to expand. That is, a current or heat (or both) may be sent through a strand of wire 290 or through another wire, such as one integrated within or next to the firestop material (such as shown in FIG. 5) to cause the firestop material to expand. Alternatively or additionally, the detection of a temperature above a threshold may cause the electrical wires to be disconnected from their power source. As such, the wires go dead and no longer aid in the spread of an electrical fire.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described hereinabove are also contemplated and within the scope of the disclosed technology.

We claim:

1. A conduit opening at, at least two ends, comprising:

a conductive metal wire extending substantially to said at least two ends;

a non-conductive wire formed primarily of heat-expandable material extending substantially to said at least two ends;

wherein said non-conductive wire is calibrated to fill, at least 90% of a cross-section of said conduit upon reaching a threshold temperature.

2. The conduit of claim 1, wherein said non-conductive wire occupies less than 25% of said cross-section before expansion, and occupies the entire free space of said cross-section after expansion.

3. The conduit of claim 2 wherein all said wires of said conduit are braided around one other, including said non-conductive wire.

4. The conduit of claim 1, wherein said non-conductive wire surrounds said conductive wires from all sides in a non-expanded condition.

5. The conduit of claim 4, wherein said non-conductive wire is permanently affixed to at least one said conductive wire.

6. The conduit of claim 4 wherein said non-conductive wire fills at least a majority of a void between said conductive wire and said conduit.

7. The conduit of claim 1 wherein, along a substantial portion of a length of said conduit between said at least two ends, said non-conductive wire fills at least 90% of any cross-section of said conduit within said portion.

8. The conduit of claim 1, wherein upon said threshold temperature being reached, said conductive wires are broken apart by said heat-expandable material.

9. The conduit of claim 1, wherein said non-conductive wire is calibrated to completely fill said conduit upon reaching a threshold temperature.

10. A conduit opening at, at least two ends, consisting of:

at least one conductive wire extending along an interior length thereof between said two ends;

a sleeve surrounding and directly engaging said conductive wire, extending between said at least two ends of said conduit;

a void defined between said sleeve and said conductive wire;

a volume of heat-expandable, non-conductive material injected into said void.

11. The conduit of claim 10 wherein said heat-expandable, non-conductive material, upon expansion, occupies at least 90% of the void extending substantially between said two ends.

12. The conduit of claim 10, wherein said non-conductive material ruptures said conductive wire upon exposure to heat exceeding a temperature threshold.

13. The conduit of claim 12, wherein said non-conductive material expands to rupture said sleeve along a longitudinal axis thereof.

14. The conduit of claim 13, wherein said fire-stop wire disables electrical connectivity of said electrical wire due to expansion of said fire-stop wire due to reaching a temperature above a threshold.

15. The conduit of claim 10, further comprising a resistance thermometer, wherein upon detection above a pre-defined threshold by said resistance thermometer, said non-conductive material is triggered to expand.

16. The conduit of claim 15, wherein upon said detection above a pre-defined threshold by said resistance thermometer, electric current to said at least one conductive wire is stopped.

17. The conduit of claim 15, wherein a first lower temperature determined by said resistance thermometer causes electric current supplied to electrical wire to be stopped and a second higher temperature causes said fire stop wire to expand.

18. A conduit extending between two portals, comprising:

a fire-stop wire extending substantially between said two portals;

an electrical wire extending through said two portals;

wherein said fire-stop wire disables electrical connectivity of said electrical wire due to expansion of said fire-stop wire due to reaching a temperature above a threshold.

19. The conduit of claim 18, wherein said temperature above a threshold is determined by a resistance thermometer.

20. The conduit of claim 19, wherein a first lower temperature determined by said resistance thermometer causes electric current supplied to electrical wire to be stopped and a second higher temperature causes said fire stop wire to expand and physically break said electrical wire, disabling electrical connectivity.

* * * * *